US007594703B2

(12) United States Patent
Hall et al.

(10) Patent No.: US 7,594,703 B2
(45) Date of Patent: Sep. 29, 2009

(54) PICK WITH A REENTRANT

(76) Inventors: David R. Hall, 2185 S. Larsen Pkwy., Provo, UT (US) 84606; Ronald Crockett, 2185 S. Larsen Pkwy., Provo, UT (US) 84606; Jeff Jepson, 2185 S. Larsen Pkwy., Provo, UT (US) 84606

( * ) Notice: Subject to any disclaimer, the term of this patent is extended or adjusted under 35 U.S.C. 154(b) by 169 days.

(21) Appl. No.: 11/748,254

(22) Filed: May 14, 2007

(65) Prior Publication Data

US 2008/0284234 A1 Nov. 20, 2008

(51) Int. Cl.
*E21C 35/18* (2006.01)

(52) U.S. Cl. ..... 299/111; 299/113

(58) Field of Classification Search ..... 299/111, 299/113

See application file for complete search history.

(56) References Cited

U.S. PATENT DOCUMENTS

| | | | | |
|---|---|---|---|---|
| 2,004,315 | A | | 6/1935 | Fean |
| 3,746,396 | A | | 7/1973 | Radd |
| 3,807,804 | A | | 4/1974 | Kniff |
| 3,932,952 | A | | 1/1976 | Helton |
| 3,945,681 | A | | 3/1976 | White |
| 4,005,914 | A | | 2/1977 | Newman |
| 4,006,936 | A | | 2/1977 | Crabiel |
| 4,201,421 | A | | 5/1980 | Den Besten |
| 4,277,106 | A | | 7/1981 | Sahley |
| 4,484,644 | A | | 11/1984 | Cook |
| 4,489,986 | A | | 12/1984 | Dziak |
| 4,627,665 | A | * | 12/1986 | Ewing et al. ..... 299/113 |
| 4,678,237 | A | | 7/1987 | Collin |
| 4,682,987 | A | | 7/1987 | Brady |
| 4,688,856 | A | | 8/1987 | Elfgen |
| 4,725,098 | A | | 2/1988 | Beach |
| 4,729,603 | A | | 3/1988 | Elfgen |
| 4,765,686 | A | | 8/1988 | Adams |
| 4,765,687 | A | | 8/1988 | Parrott |
| 4,944,559 | A | | 7/1990 | Sionnet |
| 5,011,515 | A | | 4/1991 | Frushour |
| 5,154,245 | A | | 10/1992 | Waldenstrom |
| 5,251,964 | A | | 10/1993 | Ojanen |
| 5,332,348 | A | | 7/1994 | Lemelson |
| 5,417,475 | A | | 5/1995 | Graham |
| 5,447,208 | A | | 9/1995 | Lund |
| 5,535,839 | A | | 7/1996 | Brady |
| 5,542,993 | A | | 8/1996 | Rabinkin |
| 5,653,300 | A | | 8/1997 | Lund |
| 5,823,632 | A | | 10/1998 | Burkett |
| 5,845,547 | A | | 12/1998 | Sollami |
| 5,875,862 | A | | 3/1999 | Jurewicz |
| 5,967,250 | A | | 10/1999 | Lund |
| 5,992,405 | A | | 11/1999 | Sollami |
| 6,006,846 | A | | 12/1999 | Tibbitts |
| 6,019,434 | A | | 2/2000 | Emmerich |
| 6,044,920 | A | | 4/2000 | Massa |

(Continued)

*Primary Examiner*—John Kreck
(74) *Attorney, Agent, or Firm*—Tyson J. Wilde; Jad A. Mills

(57) ABSTRACT

In one aspect of the invention, a pick adapted to degrade man-made or natural formations has a steel body comprising a shank adapted for attachment to a driving mechanism. The pick also has a leading edge opposite the shank which has an inside edge. A bore is disposed in the steel body proximate the inside edge. A cemented metal carbide core is press fit into the bore. A reentrant is formed at least partially in the bore.

11 Claims, 7 Drawing Sheets

U.S. PATENT DOCUMENTS 6,051,079 A * 4/2000 Andersson et al. ..... 299/111
6,056,911 A 5/2000 Griffin
6,113,195 A 9/2000 Mercier
6,170,917 B1 1/2001 Heinrich
6,196,636 B1 3/2001 Mills
6,196,910 B1 3/2001 Johnson
6,216,805 B1 4/2001 Lays
6,270,165 B1 8/2001 Peay
6,341,823 B1 1/2002 Sollami
6,354,771 B1 3/2002 Bauschulte
6,364,420 B1 4/2002 Sollami
6,371,567 B1 4/2002 Sollami
6,375,272 B1 4/2002 Ojanen
6,419,278 B1 7/2002 Cunningham
6,478,383 B1 * 11/2002 Ojanen et al. ..... 299/111
6,499,547 B2 12/2002 Scott
6,517,902 B2 2/2003 Drake
6,585,326 B2 7/2003 Sollami
6,685,273 B1 2/2004 Sollami
6,709,065 B2 3/2004 Peay
6,719,074 B2 4/2004 Tsuda
6,733,087 B2 5/2004 Hall
6,739,327 B2 5/2004 Sollami
6,758,530 B2 7/2004 Sollami
6,824,225 B2 11/2004 Stiffler
6,889,890 B2 5/2005 Yamazaki
6,966,611 B1 11/2005 Sollami
6,994,404 B1 2/2006 Sollami
7,204,560 B2 4/2007 Mercier
2003/0052530 A1 * 3/2003 Sollami ..... 299/111
2003/0209366 A1 11/2003 McAlvain
2004/0026983 A1 2/2004 McAlvain
2004/0065484 A1 4/2004 McAlvain
2006/0237236 A1 10/2006 Sreshta

* cited by examiner

PICK WITH A REENTRANT

BACKGROUND OF THE INVENTION

Efficient degradation of materials is important to a variety of industries including the pavement, mining, and excavation industries. In the pavement industry, pavement may be degraded using attack tools, and in the mining industry, attack tools may be used to break minerals and rocks. Attack tools may also be used when excavating large amounts of hard materials. In pavement milling, often, a drum supporting an array of picks may rotate such that the picks engage a paved surface causing it to break up.

U.S. Pat. No. 6,733,087 to Hall et al., which is herein incorporated by reference for all that it contains, discloses an attack tool for working natural and man-made materials that is made up of one or more segments, including a steel alloy base segment, an intermediate carbide wear protector segment, and a penetrator segment comprising a carbide substrate that is coated with a superhard material. The segments are joined at continuously curved interfacial surfaces that may be interrupted by grooves, ridges, protrusions, and posts. At least a portion of the curved surfaces vary from one another at about their apex in order to accommodate ease of manufacturing and to concentrate the bonding material in a region of greatest variance. The carbide used for the penetrator and the wear protector may have a cobalt binder, or it may be binderless. It may also be produced by the rapid omnidirectional compaction method as a means of controlling grain growth of the fine cobalt particles. The pats are brazed together in such a manner that the grain size of the carbide is not substantially altered. The superhard coating may consist of diamond, polycrystalline diamond, cubic boron nitride, binderless carbide, or combinations thereof.

BRIEF SUMMARY OF THE INVENTION

In one aspect of the invention, a pick adapted to degrade man-made or natural formations has a steel body comprising a shank adapted for attachment to a driving mechanism. The pick also has a leading edge opposite the shank which has an inside edge. A bore is disposed in the steel body proximate the inside edge. A cemented metal carbide core is press fit into the bore. A reentrant is at least partially formed in the bore. In some embodiments, the reentrant joins the leading edge and the bore. In other embodiments, the reentrant is formed in proximate a base of the bore.

The cemented metal carbide may be press fit into the steel body with an interference of between 0.0005 and 0.004 inch. In some embodiments, the leading edge may comprise a surface with a hardness of at least 58 HRc. The surface may comprise a material selected from the group consisting of chromium, tungsten, tantalum, niobium, titanium, molybdenum, carbide, natural diamond, polycrystalline diamond, vapor deposited diamond, cubic boron nitride, TiN, AlNi, AlTiNi, TiAlN, CrN/CrC/(Mo, W)S2 TiN/TiCN, AlTiN/MoS2, TiAlN, ZrN, diamond impregnated carbide, diamond impregnated matrix, silicon bounded diamond, and/or combinations thereof In other embodiments, a carbide ring may be fixed to the leading edge.

A distance from the leading edge to an end of the reentrant may be 0.05 to 0.20 inch. A superhard material, selected from the group consisting of diamond, cubic boron nitride, or combinations thereof, is bonded to the cemented metal carbide. The diamond may be infiltrated diamond. Metallic binder from the cemented metal carbide may diffuse into the superhard material. The distance from the leading edge to the end of the reentrant may be 25 to 100% of a thickness of the diamond.

In another aspect of the invention, the cemented metal carbide has first and second regions comprising different metal concentrations. A superhard tip bonded to the first region has a hardness over 4,000 HV. The second region is attached to the steel body. The metal concentration of the first region may be lower than the second region. The second carbide region may be brazed to the steel body or may be press fit into the steel body. The cemented metal carbide may be tungsten carbide, titanium carbide, niobium carbide, vanadium carbide, hafnium carbide, zirconium carbide, molybdenum carbide, tantalum carbide, chromium carbide or combinations thereof. The cemented metal carbide may also comprise a metallic binder selected from the group consisting of cobalt, tantalum, nickel, vanadium, chromium, niobium, or combinations thereof. The first region may comprise 2 to 12 weight percent of metallic binder whereas the second region comprises 5 to 25 weight percent of metallic binder. It is believed that the region with the lower metallic binder composition may have a greater wear resistance than the region with the higher metallic binder composition. The region with the higher metallic binder composition may better withstand impact than the region with the lower metallic binder composition. The first region may be 1 to 5 mm thick. The two regions may comprise two cemented metal carbide segments. The two cemented metal carbide segments may be brazed together. A chamfer or a reentrant may be disposed in the steel body proximate a leading edge opposite the shank.

DETAILED DESCRIPTION OF THE INVENTION AND THE PREFERRED EMBODIMENT

Figure 1:
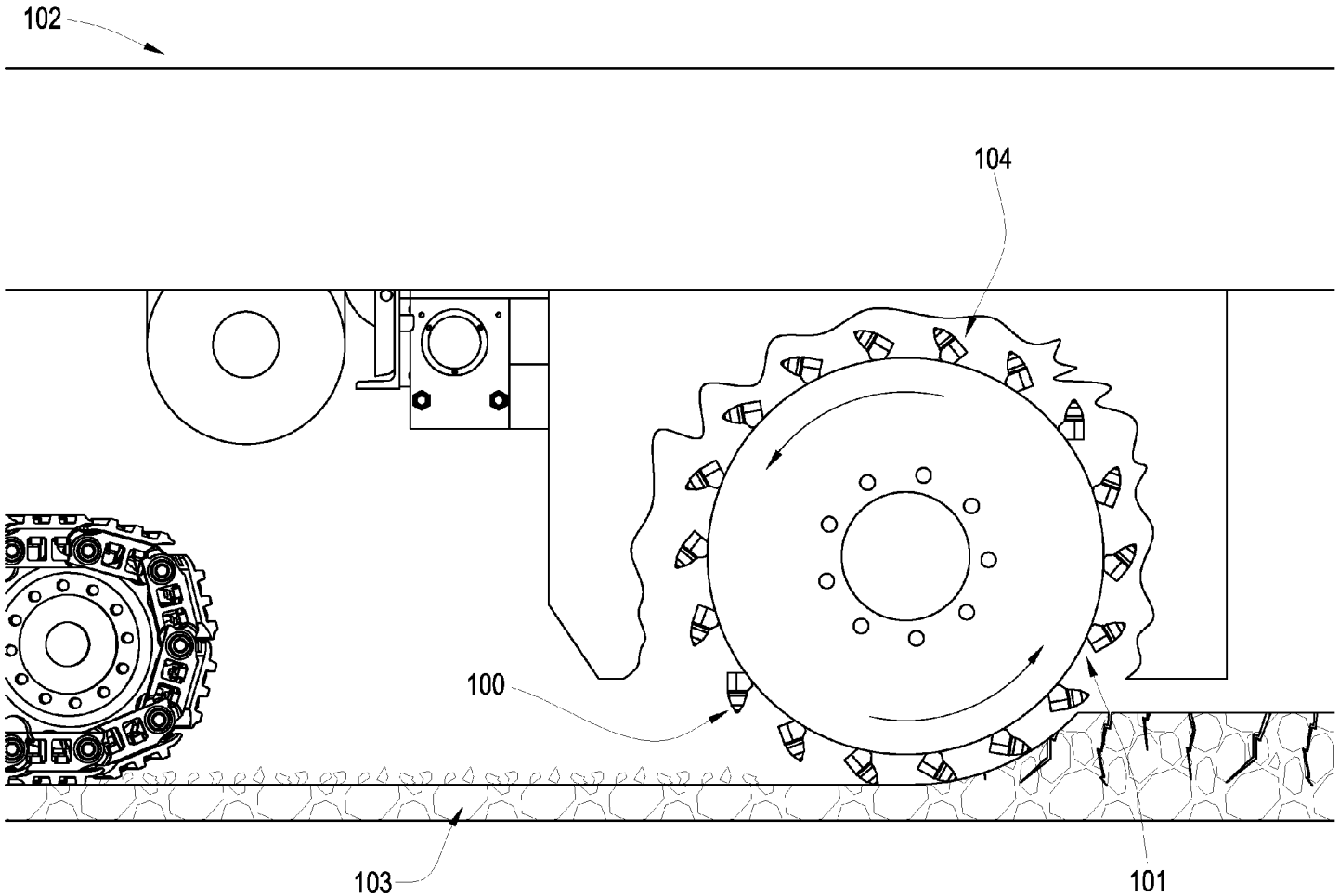
FIG. 1 is a cross-sectional diagram of an embodiment of a plurality of picks on a rotating drum attached to a motor vehicle.

FIG. 1 is a cross-sectional diagram of an embodiment of a plurality of picks 100 attached to a rotating drum 101 connected to the underside of a pavement milling machine 102. The milling machine 102 may be a cold planar used to degrade man-made formations such as pavement 103 prior to the placement of a new layer of pavement. Picks 100 may be attached to the drum 101 bringing the picks 100 into engagement with the formation. A holder 104 is attached to the rotating drum 101, and the pick 100 is inserted into the holder 104. The holder 104 may hold the pick 100 at an angle offset from the direction of rotation, such that the pick 100 engages the pavement at a preferential angle.

Figure 2:
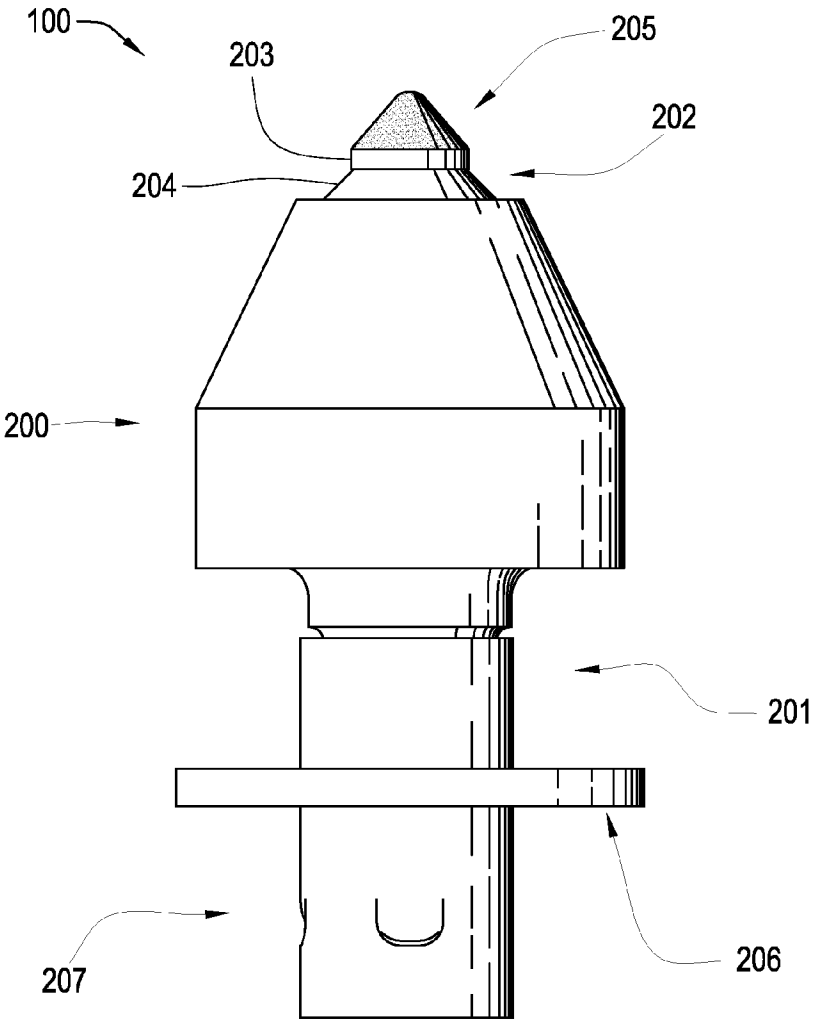
FIG. 2 is an orthogonal diagram of an embodiment of a pick.

FIG. 2 is an orthogonal diagram of an embodiment of a pick 100. The pick 100 may have a steel body 200 comprising a shank 201 adapted for attachment to a driving mechanism. In the preferred embodiment, cemented metal carbide 202 may have a first region 203 and a second region 204. The two regions 203, 204, may comprise different metal concentrations. A superhard tip 205 may be bonded to the first region 203 and the second region may be attached to the steel body 200. The metal concentration of the first region may be lower than the metal concentration of the second region. This may be beneficial in that the first region may be more wear resistant than the second region and the second region may withstand impact better than the first region. The superhard tip 205 may comprise a hardness over 4,000 HV. The superhard tip 205 may comprise a material selected from the group consisting of diamond, cubic boron nitride, or combinations thereof. The diamond may be infiltrated diamond. Metallic binder from the first cemented metal carbide 202 may diffuse into the diamond.

In the preferred embodiment, the first and second regions 203, 204, may comprise two cemented metal carbide segments. The two segments may be brazed together. The steel body 200 may also comprise a washer 206 such that when the pick 100 is inserted into a holder, the washer 206 protects an upper surface of the holder and in some cases facilitates rotation of the pick 100. The pick may also be disposed in a protective sleeve 207 such that the protective sleeve 207 protects the pick while it is being press fit into the holder and allowing the pick to rotate.

Figure 3:
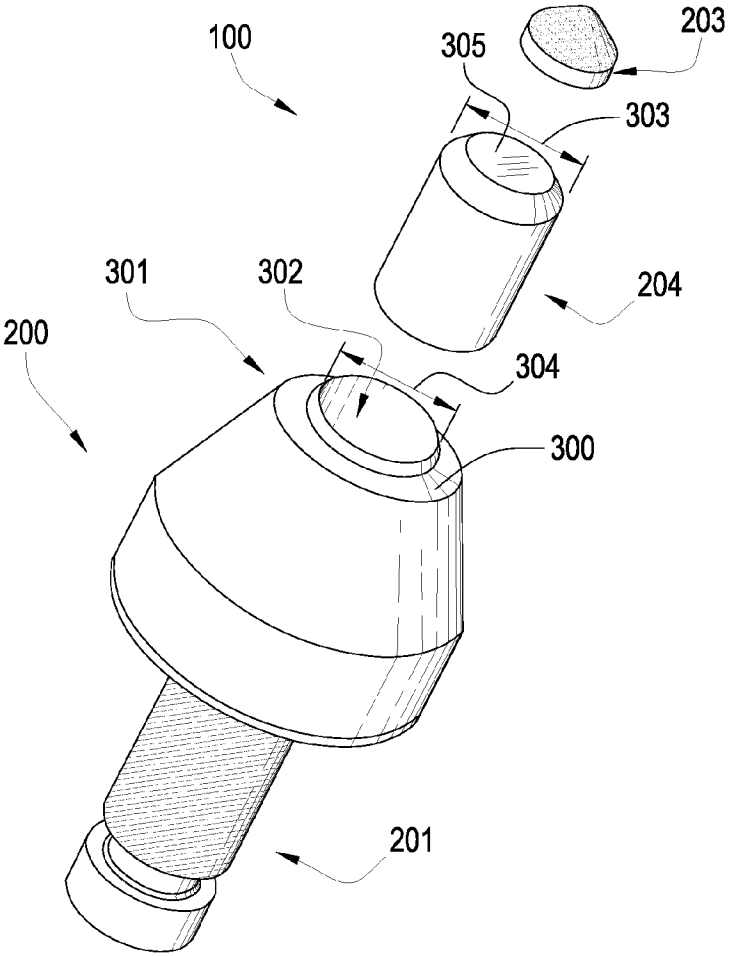
FIG. 3 is an exploded diagram of an embodiment of a pick.

An exploded diagram of an embodiment of a pick 100 is shown in FIG. 3. In the preferred embodiment, a leading edge 300 opposite the shank 201 may comprise a reentrant 301 disposed in a bore 302 of the steel body 200. The second region 204 of the cemented metal carbide 202 may be press fit into the bore 302 of the steel body 200. In other embodiments, the second region may be brazed to the steel body. The cemented metal carbide 202 may be press fit into the steel body 200 with an interference of between 0.0005 and 0.004 inch In this embodiment, the regions 203, 204, of the cemented metal carbide 202 are two segments that may be brazed together at a surface 305.

Figure 4:
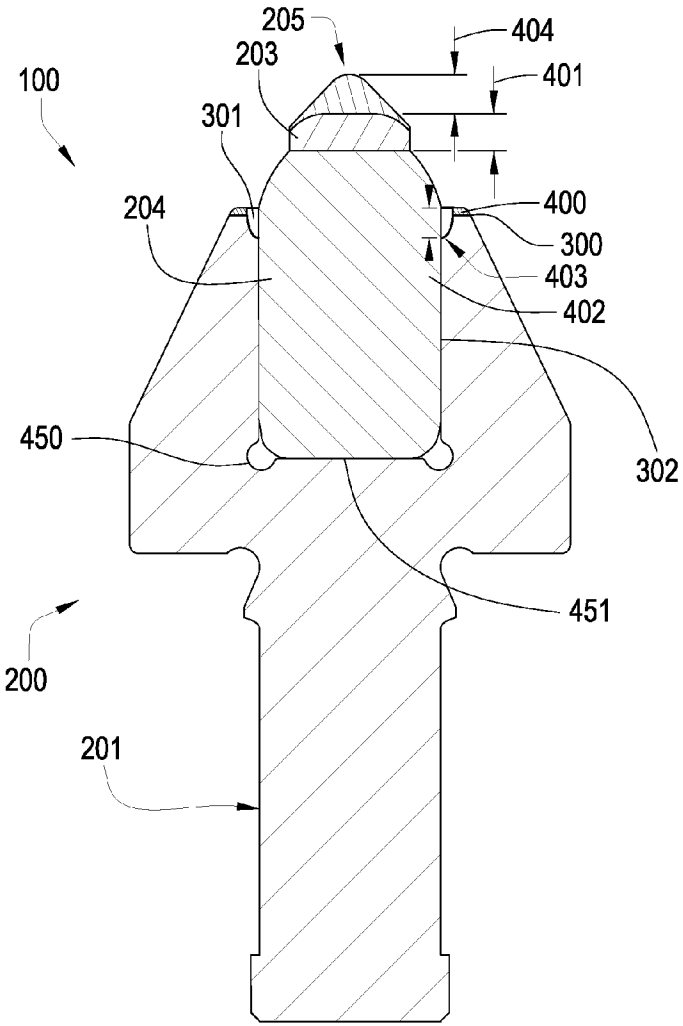
FIG. 4 is a cross-sectional diagram of another embodiment of a pick.

Referring now to FIG. 4, a pick 100 comprises cemented metal carbide first region 203 and a second region 204, the second region 204 being press fit into a steel body 200. In the preferred embodiment, a reentrant 301 may be disposed in the steel body 200 from the bore 302 to the leading edge 300 opposite the shank 201. A surprising result of the present invention shows that when the tip of the pick 100 is weakened by placing a reentrant 301 in the steel body 200, cracking may be prevented during operation The leading edge 300 may comprise a surface 400 with a hardness of at least 58 HRc. The surface 400 may comprise a material selected from the group consisting of chromium, tungsten, tantalum, niobium, titanium, molybdenum, carbide, natural diamond, polycrystalline diamond, vapor deposited diamond, cubic boron nitride, TiN, AlNi, AlTiNi, TiAlN, CrN/CrC/(Mo, W)S2, TiN/TiCN, AlTiN/MoS2, TiAlN, ZrN, diamond impregnated carbide, diamond impregnated matrix, silicon bonded diamond, and/or combinations thereof In this embodiment, the two cemented metal carbide regions 203, 204, are two separate segments. The two regions may be brazed together. The first region 203 may comprise an axial length 401 of 1 to 5 mm. A distance 402 from the leading edge 300 to an end 403 of the reentrant 301 may be 0.02 to 0.20 inch. The distance 402 may be 25% to 100% of a thickness 404 of the superhard tip 205. In some embodiments, another reentrant 450 may be formed may be formed proximate a base 451 of the bore 302.

Figure 5:
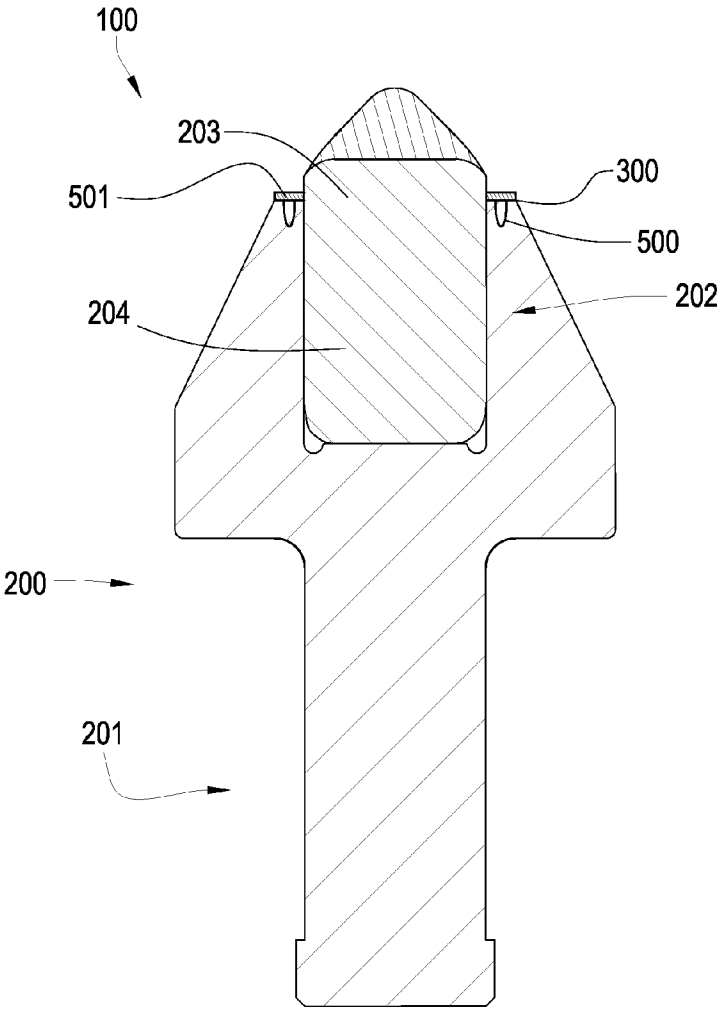
FIG. 5 is a cross-sectional diagram of another embodiment of a pick.

FIG. 5 shows another embodiment of a pick 100. In this embodiment, a reentrant 500 may be disposed in the steel body 200 proximate the leading edge 300 opposite the shank 201. This embodiment also includes a carbide ring 501 fixed to the leading edge 300. The carbide ring 501 may help to strengthen the tip. The cemented metal carbide 202 may comprise first and second regions 203, 204, having different metallic binder concentrations.

Figure 6:
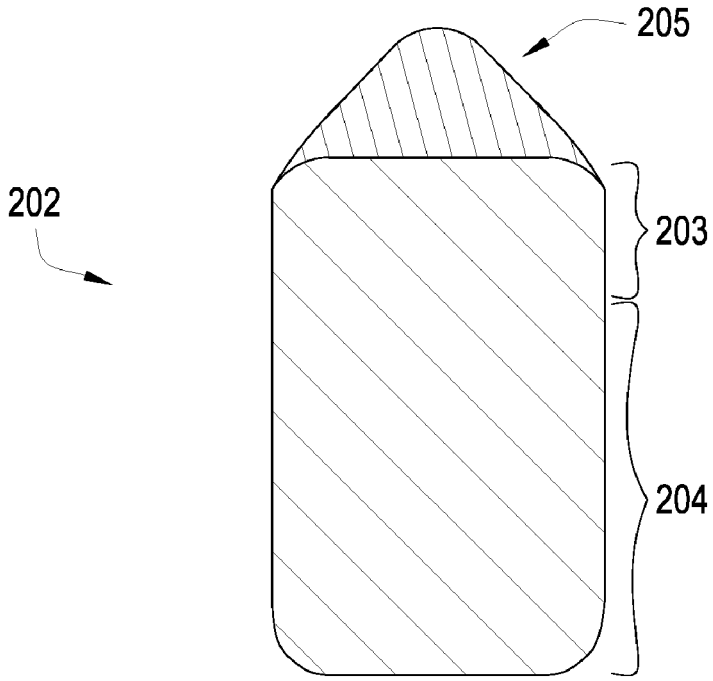
FIG. 6 is a cross-sectional diagram of another embodiment of a pick.
Figure 7:
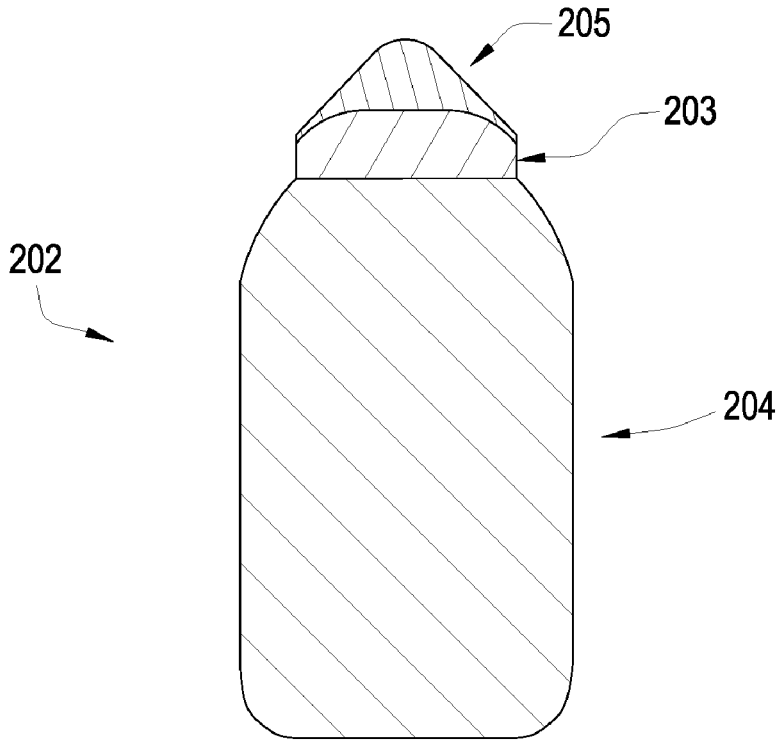
FIG. 7 is a cross-sectional diagram of another embodiment of a pick.

FIGS. 6 and 7 show embodiments of a superhard tip 205 bonded to the first region 203 of the cemented metal carbide 202. The superhard tip 205 may comprise a hardness over 4,000 HV. In FIG. 6 the first and second regions 203, 204, comprise one segment, whereas in FIG. 7 the regions 203, 204, comprise two segments. The first and second regions 203, 204, may comprise different metal concentrations. The metal concentration of the first region 203 may be lower than the metal concentration of the second region 204. This may be beneficial in that carbide with a lower metal concentration may be more wear resistant whereas carbide with a higher metal concentration is more resistant to impact. It is believed that by varying the concentrations of the two regions 203, 204, the life of the pick may be increased. The cemented metal carbide 202 may be tungsten carbide, titanium carbide, niobium carbide, vanadium carbide, hafnium carbide, zirconium carbide, molybdenum carbide, tantalum carbide, chromium carbide or combinations thereof. The cemented metal carbide 202 may have a metallic binder selected from the group consisting of cobalt, tantalum, nickel, vanadium, chromium, niobium, or combinations thereof. The first region 203 may comprise 2 to 12 weight percent of metallic binder, whereas the second region may comprise 5 to 25 percent of metallic binder. The superhard tip 205 may comprise diamond, cubic boron nitride or combinations thereof. In the preferred embodiment, the diamond may be infiltrated diamond. In such embodiments, metallic binder, such as cobalt, may diffuse from the first region 203 of the cemented metal carbide 202 into the diamond. Thus, the two regions 203, 204, of the cemented metal carbide 202 may initially comprise equal concentrations of metallic binder, but will eventually develop a differential in metallic binder concentration as cobalt or other metallic binder diffuses from the first region 203 into the diamond. In the embodiment of FIG. 7, the two regions may be brazed together. In other embodiment, the first region may have an initial lower metallic binder concentration than the second region.

Figure 10:
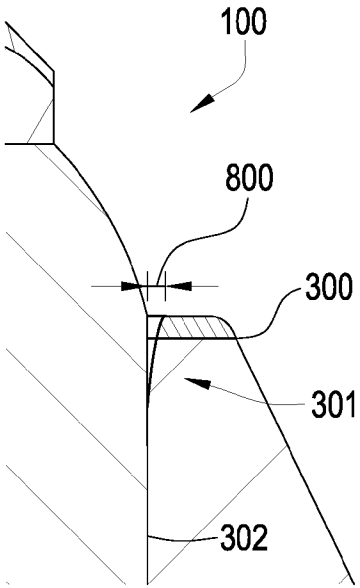
FIG. 10 is a cross-sectional diagram of another embodiment of a reentrant disposed in a pick.
Figure 9:
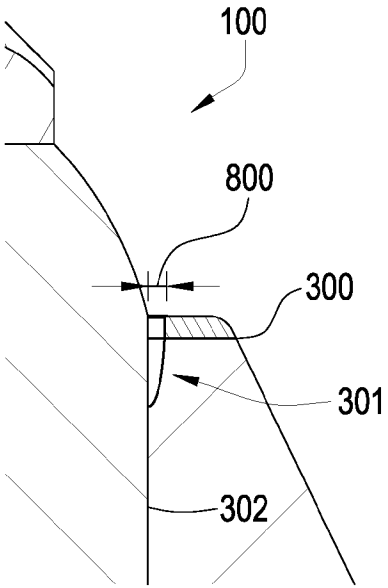
FIG. 9 is a cross-sectional diagram of another embodiment of a reentrant disposed in a pick.
Figure 8:
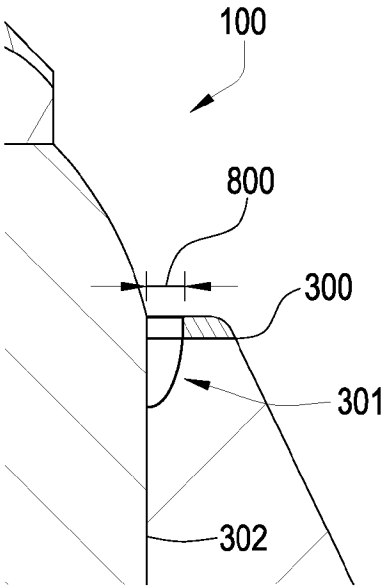
FIG. 8 is a cross-sectional diagram of an embodiment of a reentrant disposed in a pick.

A reentrant 301 disposed in the pick 100 from the bore 302 to the leading edge 300 may have different geometries as shown in various pick embodiments in FIGS. 8-10. The leading edge 300 may comprise a surface 400 with a hardness of at least 58 HRc. In FIG. 8, the pick 100 comprises a reentrant 205 with a large width 800 from the bore 302 to the leading edge 300. FIG. 9 shows a pick 100 comprising a reentrant 205 of an intermediate width 800 from the bore 302 to the leading edge 300. FIG. 10 is an embodiment of a pick 100 that comprises a reentrant 205 with a convex geometry. It is believed that different reentrant geometries may prevent cracking in different locations and with different efficiencies. In some embodiments, the reentrant may be chamfer, bevel, furrow, groove, cant, or combinations thereof.

Figure 11:
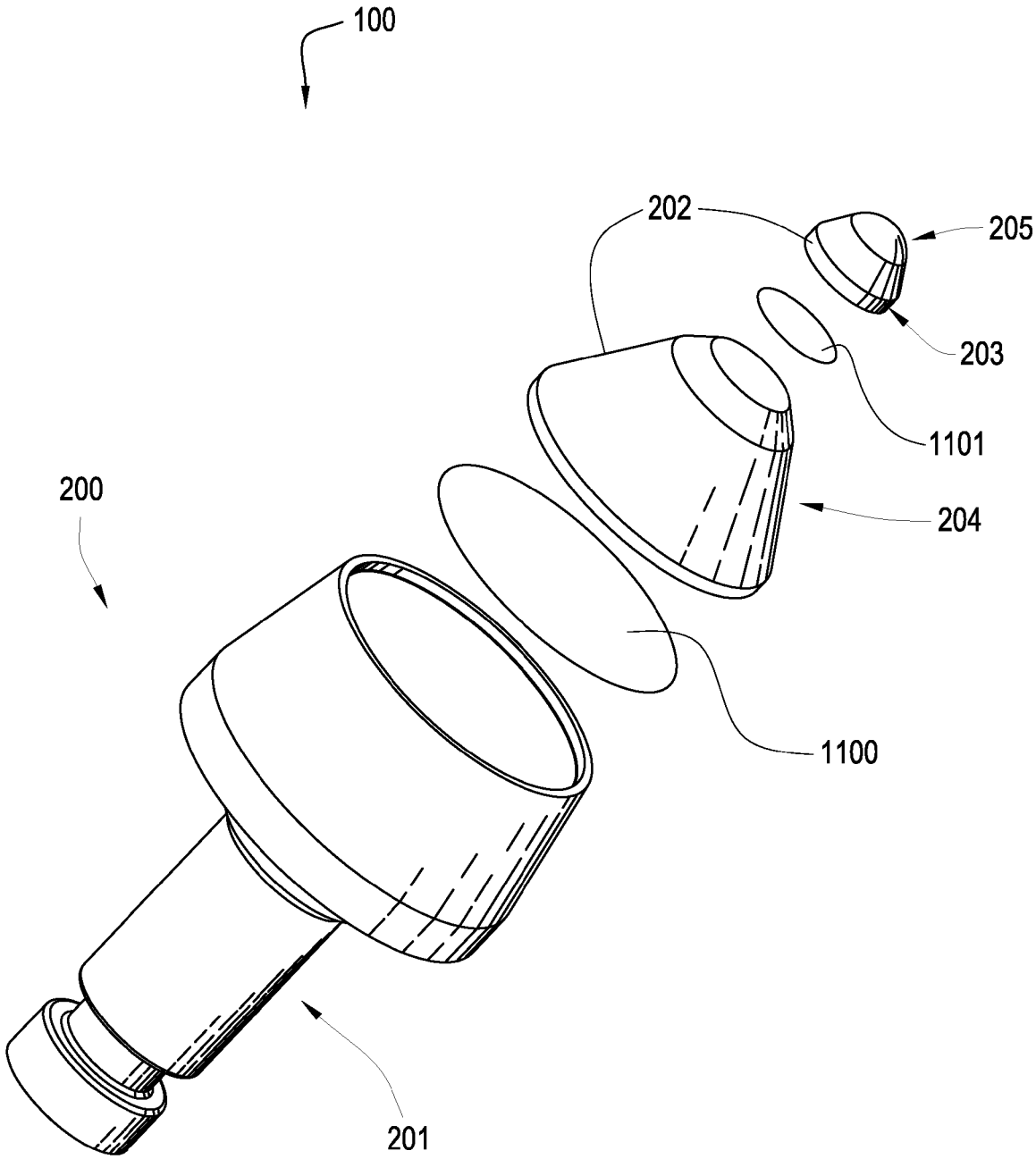
FIG. 11 is an exploded perspective diagram of another embodiment of a pick.

FIG. 11 is an exploded perspective diagram of an embodiment of a pick 100. The pick 100 may comprise a steel body

200 with a shank 201 adapted for attachment to a driving mechanism. In this embodiment, the second region 204 of the cemented metal carbide 202 may be brazed to the steel body 200 with a braze 1100. The two regions 203, 204 may comprise two segments and may also be brazed together with a braze 1101. A superhard tip 205 may be bonded to the first cemented metal carbide 203. Further, the first and second regions 203, 204, may comprise different metal compositions.

Figure 12:
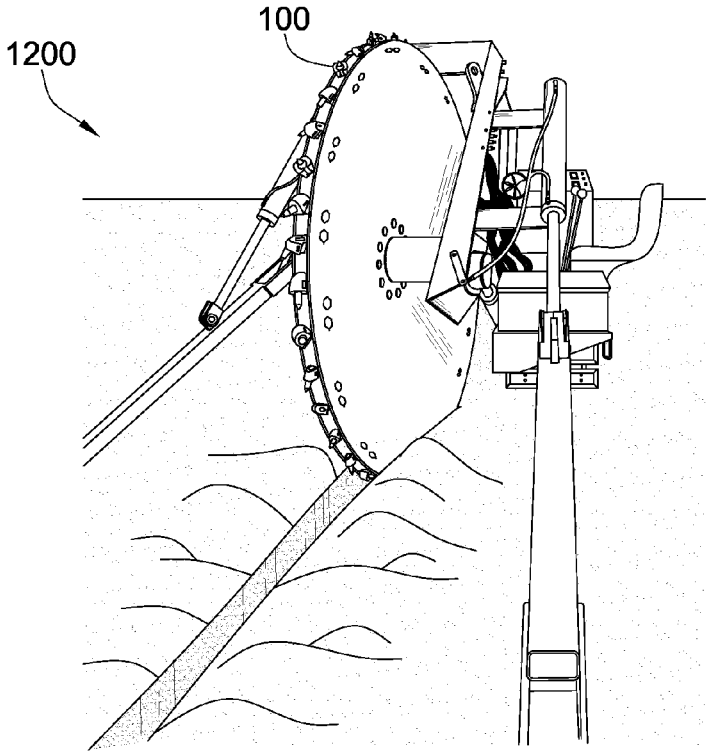
FIG. 12 is a perspective diagram of an embodiment of a trencher.
Figure 13:
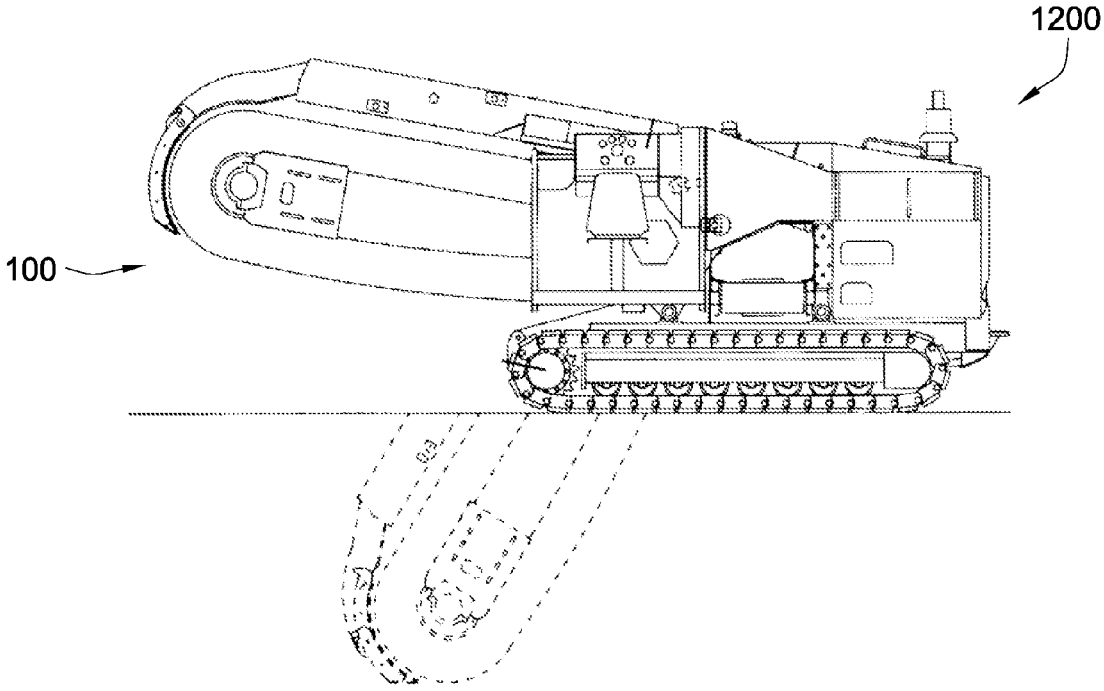
FIG. 13 is an orthogonal diagram of another embodiment of a trencher.

FIGS. 12 and 13 show various wear applications that may be incorporated with the present invention. Picks 100 may be disposed on a rock wheel trenching machine 1200 as shown in FIG. 12. Also, the picks 100 may be placed on a chain that rotates around an arm 1300 of a chain trenching machine 1200 as shown in FIG. 13.

Whereas the present invention has been described in particular relation to the drawings attached hereto, it should be understood that other and further modifications apart from those shown or suggested herein, may be made within the scope and spirit of the present invention.

What is claimed is:

1. A pick adapted to degrade man-made or natural formations, comprising:

a steel body comprising a shank adapted for attachment to a driving mechanism;

a leading edge opposite the shank, the leading edge comprising an inside edge;

a bore formed in the steel body proximate the inside edge;

a cemented metal carbide core press fit into the bore; and a chamfered reentrant at least partially formed in the bore that prevents cracking in the steel body during operation;

wherein the core is segmented.

2. The pick of claim 1, wherein the reentrant joins the inside edge to the bore.

3. The pick of claim 2, wherein a distance from the leading edge to an end of the reentrant is 0.02 to 1 inch.

4. The pick of claim 2, wherein the distance from the leading edge to the end of the reentrant is 25% to 100% of a thickness of a diamond material bonded to the core.

5. The pick of claim 1, the reentrant is formed proximate a base of the bore.

6. The pick of claim 1, wherein the cemented metal carbide core is press fit into the steel body with an interference of between 0.0005 and 0.004 inch.

7. The pick of claim 1, wherein the leading edge comprises a surface with a hardness of at least 58 HRc.

8. The pick of claim 7, wherein the surface comprises a material selected from the group consisting of chromium, tungsten, tantalum, niobium, titanium, molybdenum, carbide, natural diamond, polycrystalline diamond, vapor deposited diamond, cubic boron nitride, TiN, AlNi, AlTiNi, TiAlN, CrN/CrC/(Mo, W)S2, TiN/TiCN, AlTiN/MoS2, TiAlN, ZrN, diamond impregnated carbide, diamond impregnated matrix, silicon bonded diamond, and/or combinations thereof.

9. The pick of claim 1, wherein a carbide ring is fixed to the leading edge.

10. The pick of claim 1, wherein a superhard material, selected from the group consisting of diamond, cubic boron nitride, or combinations thereof, is bonded to the cemented metal carbide.

11. The pick of claim 10, wherein the diamond is infiltrated diamond.

* * * * *